United States Patent [19]

Wakako et al.

[11] Patent Number: 4,745,786

[45] Date of Patent: May 24, 1988

[54] HOT ROLLING METHOD AND APPARATUS FOR HOT ROLLING

[75] Inventors: Atsuhiro Wakako, Tokyo; Takeshi Ono, Tokai; Kunio Kawamura, Tokai; Kenichi Matsui, Tokai, all of Japan

[73] Assignee: Nippon Steel Corporation, Tokyo, Japan

[21] Appl. No.: 836,928

[22] Filed: Mar. 6, 1986

[30] Foreign Application Priority Data

Oct. 14, 1985 [JP] Japan ..... 60-228274

[51] Int. Cl.[4] ..... B21B 37/06

[52] U.S. Cl. ..... 72/13; 72/38; 72/39; 148/145

[58] Field of Search ..... 72/10, 12, 13, 38, 39; 148/145, D71

[56] References Cited

U.S. PATENT DOCUMENTS

| | | | |
|---|---|---|---|
| 3,411,332 | 11/1968 | Cook | 72/38 |
| 3,418,834 | 12/1968 | Cook | 72/13 |
| 3,587,268 | 6/1971 | Bricmont et al. | 72/13 |
| 3,604,234 | 9/1971 | Hinrichsen | 72/13 |
| 3,877,867 | 4/1975 | Tsuchiya et al. | 432/45 |
| 3,905,216 | 9/1975 | Hinrichsen | 72/13 |
| 4,233,830 | 11/1980 | Houdion | 72/39 |

FOREIGN PATENT DOCUMENTS

| | | |
|---|---|---|
| 81835 | 3/1983 | Australia . |
| 1777071 | 4/1971 | Fed. Rep. of Germany . |
| 53-22422 | 8/1978 | Japan . |
| 56-160502 | 3/1981 | Japan . |
| 256798 | 8/1926 | United Kingdom . |

OTHER PUBLICATIONS

Patents Abstracts of Japan, vol. 4, No. 53 (M-8) [535], Apr. 19, 1980; & JP-A-55 22 422 (Shin Nippon Seitetsu K.K.) 2-18-1980.

H. E. McGannon, "The Making, Shaping, and Treating of Steel", 9th Edition, 1971, pp. 937,944, United States Steel Corp., Pittsburgh, GB; p. 944, paragraph 1; p. 937, FIG. 32-1.

*Primary Examiner*—Robert L. Spruill
*Assistant Examiner*—Donald R. Studebaker
*Attorney, Agent, or Firm*—Pollock, Vande Sande & Priddy

[57] ABSTRACT

A hot rolling method, wherein portions of a hot-rolled steel material having suffered a temperature fall below $Ar_3$ transformation temperature thereof during hot rolling are subjected to an intermediate heating to have a temperature not less than $Ac_3$ transformation temperature before the steel material is finally finish-hot-rolled, whereby a resultant hot-rolled product can have a superior uniform structure without duplex structure, and apparatus for effecting the method.

21 Claims, 4 Drawing Sheets

HOT ROLLING METHOD AND APPARATUS FOR HOT ROLLING

BACKGROUND OF THE INVENTION

The present invention relates to a hot rolling method and an apparatus suitable for carrying out the method of the invention. More particularly, the invention is concerned with a hot rolling method in which an intermediate heating step is employed in the rolling line so as to heat the portion of the rolled material which has been cooled down below $Ar_3$ transformation temperature as the rolling proceeds, thereby attaining higher uniformity of the rolled product, as well as an apparatus suitable for carrying out this method.

Generally, hot rolling, particularly hot rolling of a hot strip, comprises heating in a heating furnace a material to be rolled, and rolling the material by use of a plurality of rough hot rolling stands and a plurality of stands for finishing tandem hot rolling adapted to roll the material into a predetermined size.

The material under hot rolling, particularly the rough-rolled material (referred to as "bar", hereinunder) having a large heat radiation area, exhibits a remarkable temperature decrease at the edges thereof, due to a stagnation thereof in the line of hot-rolling or due to a descalling by use of pressurized water, resulting in defects such as duplex grain structure or abnormal profile in the hot strip after the final hot rolling.

FIG. 1 shows a partial schematic sectional view of such a hot strip taken along the breadth of the strip, illustrating the structure of the strip. In this Figure, a duplex grain region is denoted by a numeral 1, while a numeral 2 denotes a fine grain region. Symbols (a) and (b) represent, respectively, the thicknesses of the duplex grain region at the upper and lower sides of the strip, while (t) shows the thickness of the strip.

The duplex grain region has to be severed because it impairs the quality of products. The presence of such duplex grain region, therefore, impractically reduces the yield of the product.

In order to obviate this problem, various countermeasures or methods have been proposed and adopted as follows:

(1) An ordinary countermeasure in which the material is over-heated in the heating furnace so as to effect overcompensation for possible temperature drop.

(2) Local compensation heating of the edges of the bar or skid marks portions occurring in the heating furnace, during the rough hot rolling or after the rough hot rolling but before the finish hot rolling.

(3) Local compensation heating of the edge portion in the course of finish hot-rolling as proposed in Japanese Patent Unexamined Publication No. 160502/1982.

The ordinary method (1) mentioned above is not preferred because it requires over-heating of the whole of the material and, hence, causes a large loss of energy. It is known that in the method (2) there occurs a smaller loss of energy as compared with the method (1) and the method (3) permits a further reduction in the energy loss. In the methods (2) and (3), however, the edges or skid mark portions of the material are heated in the intermediate stage of the hot-rolling substantially to the same temperature as the center portion of the material, so that the finish hot rolling is completed while whole portion of the material is still at temperatures not lower than the $Ar_3$ transformation temperature.

With this knowledge, the present inventors have conducted a test under the conditions described in Table 1, using a hot rolling line having seven finish hot rolling stands F1 to F7. In this test, the edges of the material, which had been cooled down below the $Ar_3$ transformation temperature in the course of the finish hot rolling, were heated by electric induction heating to a temperature above the $Ar_3$ transformation temperature and equal to the temperature of the breadthwise central portion of the material. The material was then subjected to a further finish hot rolling which was completed while the whole portion of the material still exhibits temperature above the $Ar_3$ transformation temperature. A microscopic observation of samples taken from the finished material showed presence of duplex grain structure in the edge portions. Thus, this method proved to be still unsatisfactory as a method for preventing the duplex grain structure from occurring.

TABLE 1

| | |
|---|---|
| Number of finishing stands | 7 |
| Heating position | Between stands F1 and F2 |
| Edge temperature (minimal surface temp. before heating) | 745° C. |
| Edge temperature (minimal temp. after heating | 846° C. |
| Temp at breadthwise center | 878° C. |
| Contents | C: 0.04%, Mn: 0.21% |
| $Ar_3$ transformation temp. | 824° C. |
| Final thickness | 2.5 mm |
| Finish hot rolling completion temp. | 827° C. |

SUMMARY OF THE INVENTION

Accordingly, an object of the invention is to provide a hot rolling method and hot-rolling apparatus capable of producing a hot-rolled material having a uniform structure free of duplex grain structure over the entire length and width of the product, thereby overcoming the above-described problems of the prior art.

Another object of the invention is to provide a hot rolling method and hot rolling apparatus capable of producing a hot-rolled product having a uniform structure with minimized energy consumption.

Still another object of the invention is to provide a hot rolling method and hot-rolling apparatus capable of preventing local wear of the roll which may otherwise be cause by local temperature reduction in the edges of the rolled material, thereby assuring longer service life of the roll and eliminating the risk of occurrence of products having abnormal profile.

The present inventors have found that, in order to achieve these objects, it is necessary to subject the portion of a steel, which has a ferrite grain structure due to temperature drop to a level below the $Ar_3$ transformation temperature during hot rolling, to an intermediate heating before the final finish hot rolling at the latest up to a temperature above the $Ac_3$ transformation temperature so that the ferrite structure may transform into austenite structure, and to subject the austenite structure to at least one step of hot rolling such that the final finish hot rolling is completed while the steel temperature is still above the $Ar_3$ transformation temperature.

According to an aspect of the invention, there is provided a hot rolling method comprising the steps of subjecting a steel material to a rough hot rolling for effecting the rough hot rolling of the steel material, and subjecting the rough-rolled steel material to a finish hot rolling for hot rolling the steel material into a predetermined shape and size, the improvement comprising the steps of: subjecting the steel material to an intermediate heating so as to heat at least a portion of the steel material, the temperature of which decreases to a level below the $Ar_3$ transformation temperature during the hot rolling, up to a temperature not lower than the $Ac_3$ transformation temperature, so as to austenitize the whole structure of the steel material, the intermediate heating being conducted after a descaling effected by pressurized water immediately before the commencement of finish hot rolling or, alternatively, during the finish hot rolling; subjecting the steel material after the intermediate heating to at least one pass of hot rolling reduction; and completing the finish hot rolling while the temperature of whole portion of the steel material is maintained at a level not lower than the $Ar_3$ transformation temperature.

Preferably, in the hot rolling method of the invention, the intermediate heating of the rolled steel before or during the finish hot rolling is conducted by determining the deviation between an actual temperature of the rolled steel measured immediately after the intermediate heating and a heating aimed temperature, and controlling the degree of the intermediate heating so that this deviation becomes substantially zero or a value within an allowable range.

It is also preferred that the intermediate heating of the rolled steel immediately after descaling by pressurized water or during finish hot rolling is carried out by determining the deviation of an actual temperature of the rolled steel measured immediately after the intermediate heating from an aimed temperature, determining the difference between an actual temperature of the rolled steel measured immediately after the completion of the finish hot rolling and another aimed temperature, and controlling the degree of the intermediate heating so that both the deviation become substantially zero or fall within respective allowable ranges.

The hot rolling reduction of the material effected after the intermediate heating is preferably at least 10%.

According to another aspect of the invention, there is provided a hot rolling apparatus comprising: a series of rough hot rolling stands; a series of finish hot rolling stands arranged in succession to the rough hot rolling stands; an intermediate heating device disposed between adjacent finish hot rolling stands or disposed immediately before the first finish hot rolling stand closest to the rough hot rolling stand which heating device effects an intermediate heating on a steel material hot-rolled; and aimed temperature computing means adapted to determine the $Ac_3$ transformation temperature and the $Ar_3$ transformation temperature of the steel material according to the composition of the steel material, and to determine, mainly on the basis of the $Ac_3$ transformation temperature and the $Ar_3$ transformation temperature, both an intermediate heating aimed temperature to which the steel material is to be heated by the intermediate heating device and a final aimed temperature at which the finish hot rolling of the steel material is to be completed, the aimed temperature computing means being operatively connected to the intermediate heating device so as to determine the heating output of the intermediate heating device.

In addition to the above-mentioned constitution requisite, the hot rolling apparatus of the invention may have a first temperature detector provided immediately downstream of the intermediate heating device so as to detect the temperature of the intermediate-heated steel, a second temperature detector provided immediately downstream of the final finish hot rolling stand so as to measure the temperature of the steel after the finish hot rolling, and controlled variable computing means which computes both a deviation of the temperature detected by the first temperature detector from an aimed intermediateheating temperature and another deviation of the temperature detected by the second temperature detector from an aimed final temperature, and controls the output of the intermediate heating device in accordance with the firstmentioned deviation, or alternatively in accordance with both the deviations.

In the hot rolling method of the invention, the $Ac_3$ transformation temperature $T(Ac_3)$ and the $Ar_3$ transformation temperature $T(Ar_3)$ of the rolled material are computed in accordance with the composition of the rolled material by, for example, the following formula.

$$T(Ac_3)=aC+bSi+cMn+dAl+e$$

$$T(Ar_3)=a'C+b'Si+c'Mn+d'Al+e'$$

The coefficients appearing in these formulae take the values shown in the following Table 2.

TABLE 2

| Symbol | a | b | c | d | e |
|---|---|---|---|---|---|
| Range | −300~−400 | 60~70 | −10~−30 | 500~600 | 800~900 |
| Symbol | a' | b' | c' | d' | e' |
| Range | −800~−900 | 50~200 | −0.1~−1.0 | −2400~−2700 | 800~900 |

Using the thus computed transformation temperatures, the intermediate heating aimed temperature and the final finish hot rolling aimed temperature are computed, that is, the aimed temperature T(HDA) at the heating device and the aimed temperature T(FDA) at the outlet of the final finish hot rolling stand.

$$T(HDA=T(Ac_3)+\Delta t\alpha_1+\Delta t\beta$$

where $\Delta t\alpha_1$ : heating compensation determined in accordance with a quality level required in product (0° to 30° C.).

$\Delta t\beta$: temperature compensation necessary for maintaining $T(Ar_3)$ at outlet of final finish hot rolling stand (0° to 50° C.).

If $T(Ar_3) > T^*(FD)$ $$t\beta - T(Ar_3) - T^*(FD)$$

If $T(AR_3) \leqq T^*(FD)$ $$\Delta t\beta 0$$

where, $T^*(FD)$: expected temperature of rolled material at outlet of final finish hot rolling stand predicted when rolled material is heated to $T(Ac_3)$ at outlet of intermediate heating device, computed by means of a temperature drop prediction model.

Using these factors, the aimed heating temperature at the outlet of the intermediate heating device is computed in such a manner as to meet the condition that the rolled material temperature at the outlet of the intermediate heating device becomes higher than the $Ac_3$ transformation temperature and also the condition that the material temperature at the outlet of the final finish hot rolling stand is above the $Ar_3$ transformation temperature According to the method of the invention, the aimed temperature T(FDA) at the outlet of the final finish hot rolling stand is computed in accordance with the following formula:

$$T(FDA)=T(Ar_3)+\Delta t\alpha_2 \text{ where,}$$

$\Delta t\alpha_2$ : heating compensation provided in accordance with the quality level (0 to 20° C.)

It is to be noted, however, the temperature T(FDA) should not exceed 920° C. because the hot rolling at the temperature T(FDA) exceeding 920° C. causes formation of scale in the finish hot-rolled product.

The intermediate heating is conducted immediately after a descaling effected by pressurized water immediately before the commencement of the final finish hot rolling or, alternatively, during the finish hot rolling. In the field of hot rolling, it is a known measure to subject, before the finish hot rolling, the rolled material to descaling with pressurized water, in order to remove a scale formed on the surface of the rolled material heated in a heating furnace. This descaling causes a large temperature drop of the rolled material, particularly at the edge portions of the same. The intermediate heating, therefore, should be effected after the descaling, on the portions of the rolled material which have been cooled down below the $Ar_3$ transformation temperature. On the other hand, in order to refine the coarse austenite grains, it is necessary that the material be subjected to at least one pass of rolling reduction of at least 10% in reduction ratio at a temperature above the $Ac_3$ transformation temperature. Hot-rolled product having no duplex grain structure cannot be obtained without this rolling reduction. The intermediate heating, therefore, is conducted immediately after the descaling effected by pressurized water immediately before the commencement of the finish hot rolling or, alternatively, the intermediate heating is conducted during the finish hot rolling. More practically, the intermediate heating is conducted at the upstream side of the first finish rolling stand which is disposed immediately downstream of the descaling device, or between the first and the second finish rolling stands, or at the upstream side of the final finish rolling stand, etc.

Any suitable heating means can be employed as the means for effecting the intermediate heating of the material. However, it is preferred that the heating means is small in size and has a high heating capacity, considering that the heating device has to be installed in a limited space between the downstream or outlet side of the descaling device and the upstream or inlet side of the final finish hot rolling stand. Thus, an induction heating device is a typical example for the heating means which is suitably used in the hot rolling apparatus of the invention.

According to the invention, a feedback control of the intermediate heating is conducted by measuring the temperature of the rolled material and feeding an output command calculated on the basis of the measured temperature back to the heating means. Namely, the temperature of the rolled material immediately after the intermediate heating measured at the outlet of the intermediate heating device and the final temperature of the rolled material measured at the outlet of the final finish hot rolling stand are compared with respective aimed temperatures computed in the manner explained before, and the differences are fed back to the control means for the intermediate heating device so as to reduce the deviation values substantially to zero or to make them fall within predetermined allowable ranges.

If the temperature of the rolled material measured immediately after the intermediate heating at the outlet of the intermediate heating device is above the aimed heating temperature T(HDA), it is credible that the final temperature after the final finish hot rolling is still above the $Ar_3$ transformation temperature, because the term $\Delta t\beta$ of the temperature compensation is selected such that, when the actual temperature after the intermediate heating is above the aimed temperature T(HDA), the final temperature after the final finish hot rolling becomes above the $Ar_3$ transformation temperature without fail. However, in considering that the temperature compensation term might be different from the actual value, it is preferred that the control of the intermediate heating be conducted while taking into account the final temperature of the rolled material at the outlet of the final finish hot rolling stand. The control of the intermediate heating on the basis of the deviation is preferably conducted continuously, through a continuous measurement of at least the temperature immediately after the intermediate heating device.

The feedback control of heating temperature cannot be applied to the leading end of the rolled material. Therefore, in a specific form of the invention, the intermediate heating of such leading end of the rolled material is conducted by setting the initial value of the intermediate heating on the basis of the temperature of the steel immediately before the intermediate heating, thickness of the material and the velocity of the material.

Thus, according to the invention, the portions of the rolled material, e.g., edges, skid-mark portions and leading and trailing ends, which have been cooled down below the $Ar_3$ transformation temperature, are subjected to an intermediate heating during the rolling so as to be heated to a temperature above the $Ac_3$ transformation temperature, whereby the hot rolling is finished while the temperatures of whole portion of the material are still above the $Ar_3$ transformation temperature. Since the hot rolling is conducted while temperatures above the $Ar_3$ transformation temperature are maintained over the entire length and breadth of the hot rolled material, the fear of occurrence of the duplex grain structure is prevented effectively. In addition, since the edge portions of the rolled material are maintained at such temperature, the deformability of these edge portions is increased so that the tendency of local wear of the rolls is remarkably suppressed advantageously.

DESCRIPTION OF THE PREFERRED EMBODIMENTS

First Embodiment

Figure 5:
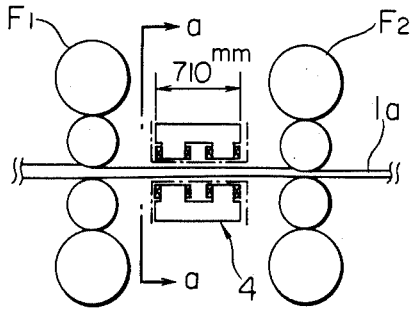
FIG. 5 is an illustration of the positional relationship between the rolled material and an electromagnetic induction heating device which is used as an intermediate heating device, as viewed in the direction of rolling.
Figure 6:
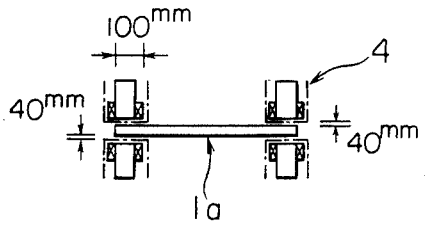
FIG. 6 shows the positional relationship between the electromagnetic induction heating device and the rolled material as viewed in the breadthwise direction of the rolled material.

A low carbon steel slab containing 0.04% of C and 0.21% of Mn, 245 mm in thickness, 1500 mm in width and 9000 mm in length, was first heated to 1180° C., and was subjected to a rough hot rolling to become a bar 1*a* of 35 mm thick and 1450 mm wide. This bar 1*a* was subjected to a descaling by a descaling device 31 and the bar 1*a* after the descaling was subjected to an intermediate heating conducted by an edge heating device comprising an electromagnetic induction heating device 4 (maximum power 660 kw at each side) disposed between the first and second stands F1 and F2 of a finish hot rolling mill comprising seven finish hot rolling stands F1 to F7. More specifically, the heating was conducted locally on the portion of 100 mm wide as measured from the outermost edge on each side of the bar 1*a*, by the application of effective heating electric power of 600 kw on each side of the bar 1*a*. As shown in FIGS. 5 and 6, the heating device 4 was placed at a gap of 40 mm from the upper and lower surfaces of the edge portions of the bar 1*a*, over a length of 710 mm in the direction of movement of the bar 1*a*. The bar was finally hot-rolled into a final size of 2.5 mm in thickness and 1450 mm in width.

Figure 2:
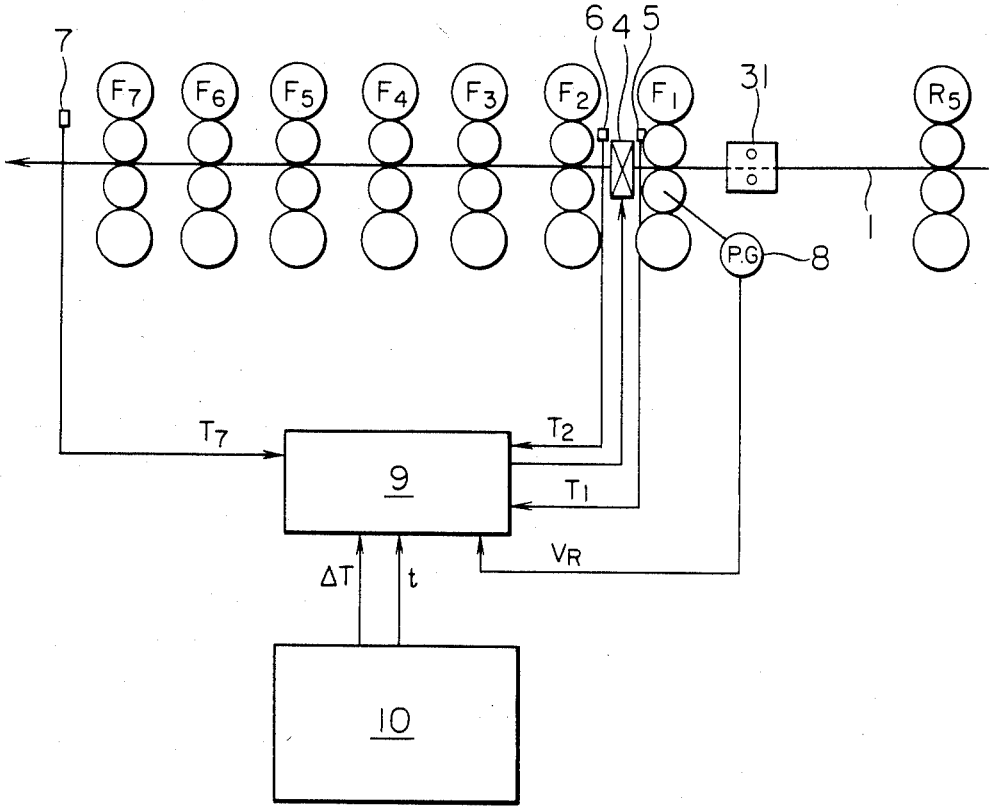
FIG. 2 is an illustration of an intermediate heating control device employed in a first embodiment of the invention.

FIG. 2 schematically shows the apparatus used in the first embodiment. In this Figure, a reference numeral 31 denotes a descaling device which descales the bar 1*a* by pressurized water, while 5 and 6 denote breadthwise scanning type radiation thermometers which are arranged at the upstream or inlet side and downstream or outlet side of the edge heating device 4. A numeral 7 designates a breadthwise scanning type radiation pyrometer disposed at the outlet or downstream side of the final finish rolling stand and adapted for measuring the final temperature of the hot rolled product. A reference numeral 8 denotes a pulse generator which is adapted for counting the number of rotations of the roll. Numerals 9 and 10 denote, respectively, a controller for the edge heating device 4 and a computer for setting various conditions.

Figure 3:
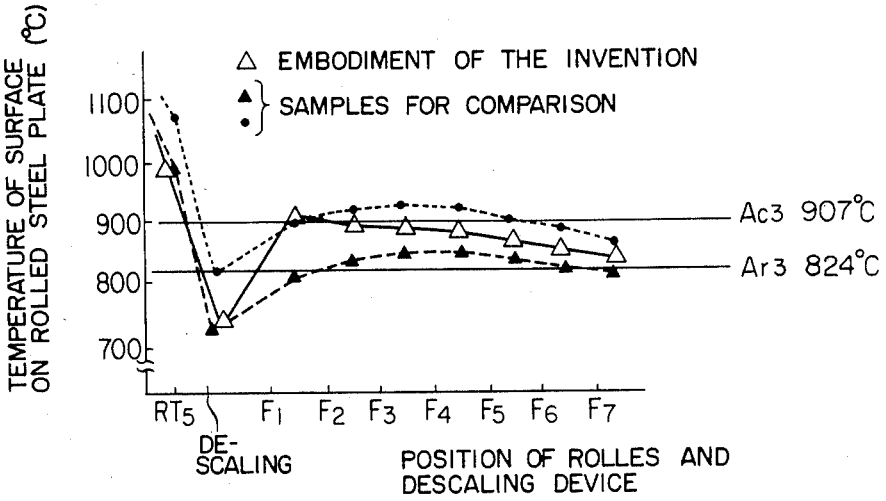
FIG. 3 is a graph showing the temperature hysteresis of the breadthwise central portions and the edge portions of the rolled material hot-rolled by the first embodiment of the invention and another rolled material according to a comparison method.

The heating controller 9 is adapted to receive the actual temperatures $T_1$, $T_2$ of the bar 1*a* transmitted from the pyrometer 5,6. The controller 9 also receives the aimed temperature $\Delta T$ which is determined on the basis of various factors such as the rolling velocity VR transmitted from the pulse generator 8, final temperature $T_7$ transmitted from the pyrometer 7, a $Ac_3$ transformation temperature, and an estimated temperature drop in the subsequent hot rolling. The $Ac_3$ transformation temperature is determined by a process computer 10 in accordance with data such as the bar thickness and the material composition. Upon receipt of both the actual temperatures and the aimed temperature, the heating controller outputted a value of 600 kw as the heating output which is to be outputted from the edge heating device 4. In FIG. 3, the change in the temperature when the bar la was heated by this heating output is plotted at mark Δ. The edge portions which were cooled down below the $Ar_3$ transformation temperature by the pressurized-water descaling device 31 were subjected to the intermediate heating so as to be heated up to 910° C. which is above the $Ac_3$ transformation temperature, and the bar la after this intermediate heating was subjected to ordinary finish hot rolling. The finish rolling was completed at the final temperature of 837° C. The $Ar_3$ transformation temperature and the $Ac_3$ transformation temperature were 824° C. and 907° C., respectively.

Figure 4:
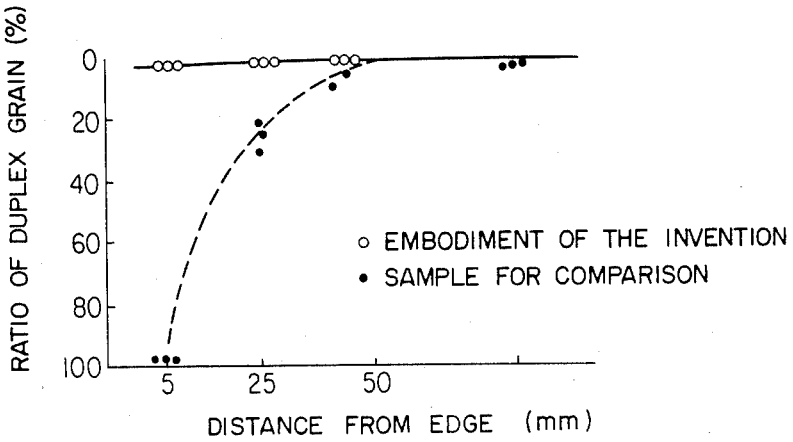
FIG. 4 is an illustration of the rate of occurrence of the duplex grain structure as observed in the first embodiment of the invention and in a comparison example.

FIG. 4 shows the result of an examination of the structure of samples extracted from the rolled product, for the purpose of checking for the presence of duplex grain structure.

In comparison examples, the operation till the completion of rough hot rolling was conducted under the same condition as that in the described embodiment, but the rough hot-rolled bar was directly subjected, without any intermediate heating, to an ordinary finish rolling so as to be rolled into a coil of 2.5 mm thick and 1450 mm wide at the final temperature of 826° C. The temperature change in the comparison examples operation is plotted by black circle and black triangle marks ● and ▲ in FIG. 3. FIG. 4 shows the result of examination conducted on samples extracted from the coil of the comparison example, for the purpose of checking for the presence of duplex grain structure.

Figure 1:
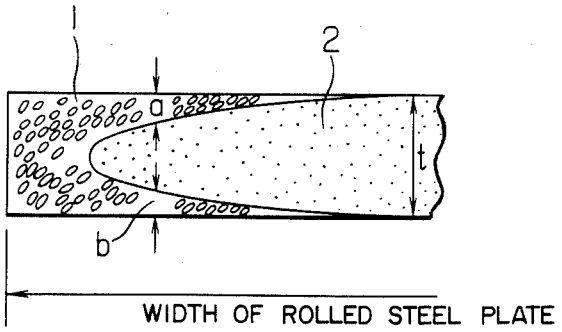
FIG. 1 is a schematic sectional view of a hot rolled material illustrating the presence of a duplex grain structure.

The duplex grain ratio represented by the axis of ordinate in FIG. 4 is a ratio which is given as $(a+b/t)\times 100$, where (a) and (b) are thicknesses shown in FIG. 1.

From FIG. 4, it will be understood that the first embodiment of the invention effectively prevents the occurrence of duplex grain structure, and ensures high uniformity of the hot-rolled product. In contrast, the comparison examples showed the presence of duplex grain structure locally in the edge regions of 45 mm wide as measured from the outer extremity of the edge, thus proving an inferior quality of the product.

Second Embodiment

Figure 7:
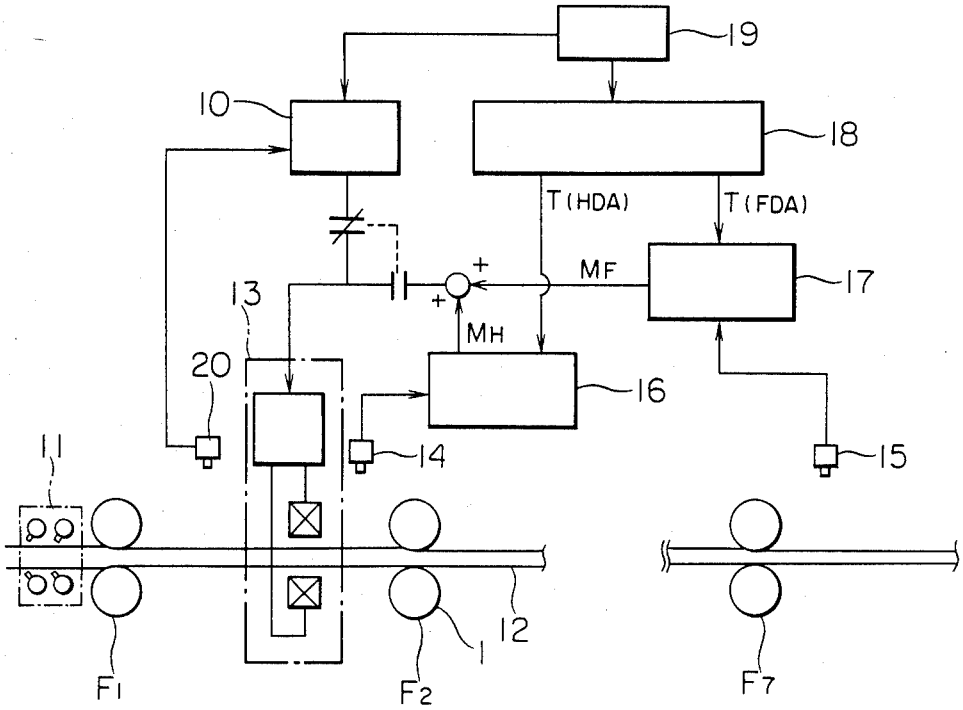
FIG. 7 is an illustration of a second embodiment of the invention, showing particularly the intermediate heating control means used in the second embodiment.
Figure 8:
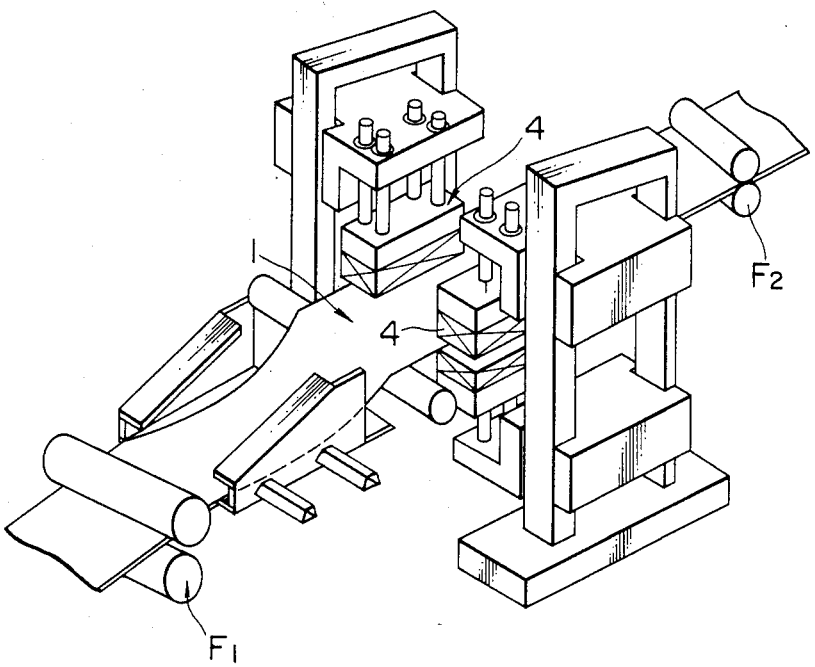
FIG. 8 is a perspective view of an intermediate heating device comprising an electromagnetic heater.

A second embodiment will be explained hereinunder with reference to FIG. 7.

This embodiment employs a specification setting device 19 for setting the specification of the rolled material, e.g., the thickness, moving velocity and the composition of the rolled material. Using the composition specification given by the specification setting device 19, an aimed temperature computing device 18 computed the $Ac_3$ transformation temperature and the $Ar_3$ transformation temperature, and computed also the intermediate heating aimed temperature T(HDA) and the final aimed temperature T(FDA) on the basis of the thus computed $Ac_3$ and $Ar_3$ transformation temperatures. The intermediate heating aimed temperature T(HDA) and the final aimed temperature T(FDA) were imputted as aimed values to controlled variable computing devices 16 and 17.

A reference numeral 13 denotes an electromagnetic induction heating device (output 660 kw at each side) which is the same as that used in the first embodiment and disposed between the first stand F1 and the second stand F2 of the finish hot rolling mill. The practical arrangement of the heating device 13 with respect to the edges of the hot rolled steel is substantially the same as that in the first embodiment. Reference numerals 14 and 15 denote, respectively, breadthwise scanning type pyrometers which are disposed, respectively, at the outlet side of the intermediate heating device and the outlet side of the final stand of the finish hot rolling mill. A numeral 20 designates another breadthwise scanning type pyrometer provided on the inlet side of the heating device.

In order to control the actual hot-rolled material temperature immediately after the intermediate-heating in conformity with the intermediate heating aimed temperature T(HDA), the temperature measured by the pyrometer 14 was fed back and the manipulated variable M(H) was computed by the manipulated variable computing device 16 from the deviation of the actual temperature from the aimed temperature. Similarly, in order to control the actual final temperature immediately after the final finish hot rolling in conformity with the final aimed temperature T(FDA), the temperature measured by the pyrometer 15 was fed back and the manipulated variable M(F) was computed by the manipulated variable computing device 17 from the deviation of the fed-back actual temperature from the aimed temperature. The heating device 13 was controlled to vary its output in accordance with the sum of the manipulated variables M(H) and M(F). Since the feedback of the actual temperature cannot be conducted until the rolled material reaches the pyrometer 14 or 15, the temperature control was conducted in accordance with an initial value which is set by an initial heating temperature setting device 10 as in the case of the first embodiment, until the feedback of the actual temperature became available.

Tables 3a and 3b show the result of the hot rolling operation conducted in accordance with the second embodiment.

Three types of materials were used in this hot rolling. All the material had an initial thickness of 35 mm before they were subjected to the hot rolling. The widths were 1250 mm, 1091 mm and 1112 mm, respectively.

TABLE 3a

| Sample No. | Size of hot rolled material thickness × width (mm) | Composition (wt %) C | Si | Mn | AL | Transformation Temperature (° C.) $Ac_3$ | $Ar_3$ | Temperature at outlet of intermediate heating device (°C.) Aimed temperature | Heating pattern No heating | 100% heating | Controlled heating | Heating control output (%) |
|---|---|---|---|---|---|---|---|---|---|---|---|---|
| 1a | 2.3 × 1250 | 0.034 | 0.011 | 0.22 | 0.005 | 867 | 838 | 887 | 863 | — | — | 0 |
| 1b | " | " | " | " | " | " | " | " | — | 893 | — | 100% |
| 1c | " | " | " | " | " | " | " | " | — | — | 887 | 66% |
| 2a | 4.5 × 1091 | 0.10 | 0.03 | 0.74 | 0.001 | 834 | 795 | 844 | 820 | — | — | 0 |
| 2b | " | " | " | " | " | " | " | " | — | 852 | — | 100% |
| 2c | " | " | " | " | " | " | " | " | — | | 844 | 71% |
| 3a | 3.5 × 1112 | 0.08 | 0.017 | 0.40 | 0.002 | 846 | 808 | 856 | 824 | — | — | 0 |
| 3b | " | " | " | " | " | " | " | " | — | 861 | — | 100 |
| 3c | " | " | " | " | " | " | " | " | — | — | 857 | 98 |

TABLE 3b

| Example | Temperature at finish hot rolling mill outlet (°C.) Aimed temp. | Heating pattern No heating | 100% heating | Controlled heating | Duplex grain ratio (%) measured at a position spaced apart 10 mm from edge |
|---|---|---|---|---|---|
| 1a | 853 | 840 | — | — | 39 |
| 1b | " | — | 869 | — | 0 |
| 1c | " | — | — | 862 | 0 |
| 2a | 805 | 802 | — | — | 43 |
| 2b | " | — | 834 | — | 0 |
| 2c | " | — | — | 824 | 0 |
| 3a | 818 | 798 | — | — | 100 |
| 3b | " | — | 837 | — | 0 |
| 3c | " | — | — | 833 | 0 |

Referring to Tables 3a and 3b, sample Nos. 1a, 2a and 3a show comparison rolled materials. The comparison rolled material 1a exhibits an inferior quality of 39% or higher in terms of the duplex grain ratio, due to the fact that the material temperature at the outlet side of the intermediate heating device was below the $Ac_3$ transformation temperature. The same applies also to the comparison rolled material 2a which showed a high duplex grain ratio of 43% due to the fact that the temperature at the outlet of the intermediate heating device is below $Ac_3$ transformation temperature. In the case of the comparison rolled material 3a, the whole structure was the duplex grain structure, i.e., the duplex grain ratio was 100%, because the temperature at the outlet of the intermediate heating device and the temperature at the outlet of the final finish rolling stand were much lower than the $Ac_3$ and $Ar_3$ transformation temperatures, respectively.

Sample Nos. 1c, 2c and 3c were products which were hot-rolled under the intermediate heating control in accordance with the second embodiment of the invention. Thus, the sample Nos. 1c, 2c and 3c were subjected to intermediate heating which was conducted under such a control as to have the intermediate heating temperature and the final temperature not lower than the $Ac_3$ transformation temperature and not lower than the $Ar_3$ transformation temperature, respectively. In consequence, the rolling could be conducted in such a way as to ensure a high quality of the final rolled steel product without occurrence of duplex grain structure, with minimized electric power consumption.

In tables 3a and 3b, the term "100%" appearing in the column of the "heating control output" means that the electromagnetic induction heating device 13 was manually controlled to constantly output the full power of 660 kw at each side.

In the second embodiment described hereinbefore, the difference or deviation between the actual temperature and the aimed temperature was obtained continuously both for the temperature at the outlet side of the intermediate heating device and the outlet side of the final stand of the finish hot rolling mill, and the output of the intermediate heating device was controlled continuously in accordance with the values of both temperature deviations. This, however, is not exclusive and the arrangement may be such that the temperature deviation at the outlet side of the final stand of the finish hot rolling mill is detected only in the initial period of the continuous hot rolling operation or, alternatively, only intermittently at a suitable predetermined time interval.

As has been described, according to the invention, the portions in the hot-rolled material which portions have become below the $Ar_3$ transformation temperature in the course of hot rolling are subjected to an intermediate heating after a pressurized-water-using descaling conducted immediately before the finish hot rolling or, alternatively, during the finish hot rolling, so as to be heated to a temperature not lower than the $Ac_3$ transformation temperature, the material being then subjected to at least one pass of rolling such that the finish hot rolling is completed at a temperature not lower than the $Ar_3$ transformation temperature.

According to the invention, therefore, it is possible to obtain a hot-rolled product having a uniform structure along the breadth over the entire length of the same, without occurrence of duplex grain structure. In view of the current demand for energy preservation, heating of rolled material at low temperature is becoming a matter of a greater concern. From this point of view, it is to be highly evaluated that the invention permits an efficient relatively low-temperature intermediate heating of the material under the rolling without causing any deterioration of the product quality. In addition, when the intermediate heating is carried out in such a manner that the edge portions of the material under rolling, which suffers the greatest temperature drop, are locally heated at least before the final finish hot rolling, the undesirable local wear of the finishing rolls can be prevented or minimized because the heated edge portions exhibit a greater deformability, so that the service life of the finishing hot rolls is prolonged and the tendency of occurrence of abnormal profile is prevented remarkably. Furthermore, the intermediate heating applied to the leading and trailing ends of the material, which also suffers large temperature drop, offers various industrial advantages such as reduction in the impact which occurs when the material is introduced into the hot rolling mill and prevention of damaging of the roll surfaces.

What is claimed is:

1. In a hot rolling method comprising rough-hot-rolling a steel material, descaling the rough-hot-rolled steel material to remove scale by use of pressurized water so that a temperature of at least a portion of said steel material decreases below $Ar_3$ transformation temperature of the steel material, and finish-hot-rolling the descaled steel material, the improvement comprising the steps of: subjecting said steel material to an intermediate heating of at least a portion of said steel material, the temperature of which portion decreases below the $Ar_3$ transformation temperature of the steel material, to a temperature not lower than the $Ac_3$ transformation temperature of the steel material so that the metallurgical structure of the whole of said steel material becomes austenite, said intermediate heating being effected during said finish-hot-rolling;

subjecting said steel material having a single phase of austenite structure to at least one pass of finish hot-rolling after the intermediate heating; and completing the final finish hot-rolling while the temperature of the steel material is at a temperature not less than the $Ar_3$ transformation temperature.

2. A hot rolling method according to claim 1, wherein said intermediate heating is effected on the edge portions of said steel material.

3. A hot rolling method according to claim 1, wherein said intermediate heating is carried out so that the temperature of said steel material immediately after said intermediate heating is not lower than the $Ac_3$ transformation temperature while the final temperature said steel material immediately after the completion of the finish hot rolling is not lower than the $Ar_3$ transformation temperature.

4. A hot rolling method according to claim 1, wherein said intermediate heating is conducted so that the temperature of said steel material at the immediately after said intermediate heating becomes substantially an intermediate heating aimed temperature T(HDA) which is given by the following formula:

$$T(HDA) = T(Ac_3) + \Delta t\alpha_1 + \Delta t\beta$$

where, $T(Ac_3)$: $Ac_3$ transformation temperature, $\Delta t\alpha_1$: heating compensation determined in accordance with a quality level required in product which is in the range of 0° to 30° C., $\Delta t\beta$ : temperature compensation necessary for maintaining $T(Ar_3)$ at outlet of final finish hot rolling stand which is in the range of 0° to 50° C.

5. A hot rolling method according to claim 1, wherein said intermediate heating is conducted so that the final temperature of said steel material immediately after the final finish hot rolling becomes substantially a final aimed temperature which is given by the following formula:

$$T(FDA) = T(Ar_3) + \Delta t\alpha_2$$

where $T(Ar_3)$: $Ar_3$ transformation temperature, $\Delta t\alpha_2$ : heating compensation provided in accordance with the level of quality which is in the range of 0° to 20° C.

6. A hot rolling method according to claim 1, wherein the $Ac_3$ transformation temperature $T(Ac_3)$ and the $Ar_3$ transformation temperature $T(Ar_3)$ are given by the following formulae:

$$T(Ac_3)=aC(wt\%)+bSi(wt\%)+cMn(wt\%)+dAl(wt\%)+e$$

$$T(Ar_3)=a'\,C(wt\%)+b'\,Si(wt\%)+c'\,Mn(wt\%)+d'Al(wt\%)+e'$$

where, a to e' are constants which fall with the following ranges:

a: −300 to −400
b: 60 to 70
c: −10 to −30
d: 500 to 600
e: 800 to 900
a ': −800 to −900
b': 50 to 200
c':−0.1 to −1.0
d': −2400 to −2700 and
e': 800 to 900.

7. A rolling method according to claim 1, wherein the finish hot rolling reduction ratio after said intermediate heating is at least 10%.

8. A hot rolling method according to claim 1, wherein descaling of said steel material is conducted by pressurized water while said material is between the rough hot rolling step and finish hot rolling step.

9. In a hot rolling method comprising rough-hot-rolling a steel material, descaling the rough-hot-rolled steel material to remove scale by use of pressurized water so that a temperature of at least a portion of said steel material decreases below $Ar_3$ transformation temperature of the steel material, and finish-hot-rolling the descaled steel material, the improvement comprising the steps of: subjecting said steel material to an intermediate heating at least a portion of said steel material, the temperature of which portion falls below the $Ar_3$ transformation temperature of the steel material, to a temperature not lower than the $Ac_3$ transformation temperature of the steel material so that the metallurgical structure of the whole of said material becomes austenite, said intermediate heating being effected during said finish-hot-rolling;

subjecting said steel material having a single phase of austenite structure to at least one pass of finish hot-rolling after the intermediate heating;

completing the final finish hot-rolling while the temperature of the steel material is at a temperature not less than the $Ar_3$ transformation temperature, obtaining a first deviation of a temperature of said steel material measured immediately after the intermediate heating from an intermediate heating aimed temperature, and a second difference between a temperature of the steel material measured immediately after the completion of the final finish hot-rolling and a final finish hot-rolling aimed temperature; and changing the degree of the intermediate heating in accordance with at least said first deviation regarding the first and second temperature deviation.

10. A hot rolling method according to claim 9, wherein said intermediate heating is effected on the edge portions of said steel material.

11. A hot rolling method according to claim 9, wherein said intermediate heating is carried out so that the temperature of said steel material immediately after said intermediate heating is not lower than the $Ac_3$ transformation temperature while the final temperature of said steel material immediately after the completion of the fihish hot rolling is not lower than the $Ar_3$ transformation temperature.

12. A hot rolling method according to claim 9, wherein said intermediate heating is conducted so that the temperature of said steel material at the immediately after said intermediate heating becomes substantially an intermediate heating aimed temperature T(HDA) which is given by the following formula:

$$T(HDA)=T(Ac_3)+\Delta t\alpha_1+\Delta t\beta$$

where, $T(Ac_3)$: $Ac_3$ transformation temperature, $\Delta t\alpha_1$ heating compensation determined in accordance with a quality level required in a product which is in the range of 0° to 30° C., $\Delta t\beta$ : temperature compensation necessary for maintaining $T(Ar_3)$ at outlet of final finish hot rolling stand which is in the range of 0° to 50° C.

13. A hot rolling method according to claim 9, wherein said intermediate heating is conducted so that the final temperature of said steel material immediately after the final finish hot rolling becomes substantially a final aimed temperature which is given by the following formula:

$$T(FDA)=T(Ar_3)+\Delta t\alpha_2$$

where, $T(Ar_3)$: $Ar_3$ transformation temperature, $\Delta t\alpha_2$: heating compensation provided in accordance with the level of quality which is in the range of 0° to 20° C.

14. A hot rolling method according to claim 12, wherein the $Ac_3$ transformation temperature $T(Ac_3)$ and the $Ar_3$ transformation temperature $T(Ar_3)$ are given by the following formulae:

$$T(Ac_3)=aC(wt\%)+bSi(wt\%)+cMn(wt\%)+dAl(wt\%)+e$$

$$T(Ar_3)=a'\,C(wt\%)+b'\,Si(wt\%)+c'\,Mn(wt\%)+d'\,Al(wt\%)+e'$$

where, a to e' are constants which fall with the following ranges:

a: −300 to −400
b: 60 to 70
c: −10 to −30
d: 500 to 600
e: 800 to 900
a': −800 to −900
b': 50 to 200
c': −0.1 to −1.0
d': −2400 to −2700 and
e': 800 to 900.

15. A rolling method according to claim 9, wherein the finish hot rolling reduction ratio after said intermediate heating is at least 10%.

16. A hot rolling method according to claim 9, wherein descaling of said steel material is conducted by pressurized water while said material is between the rough hot rolling step and finish hot rolling step.

17. A hot rolling method according to claim 9, wherein the detection of difference between the measured temperature of said steel material immediately after said intermediate heating and said intermediate heating aimed temperature is conducted continuously, while the detection of the difference between an actually measured temperature of the steel material immediately after the completion of finish hot rolling and a final finish hot rolling aimed temperature is conducted at least in the initial period of the hot rolling operation, and the degree of heating in said intermediate heating is varied in accordance with both of the differences.

18. Hot rolling apparatus comprising: a series of rough hot rolling stand; descaling means for removing scale of the hot rolled steel material, said descaling means being arranged after the rough hot rolling stand; a series of finish hot rolling stand arranged after the descaling means; an intermediate heating device disposed between adjacent finish hot rolling stands or immediately downstream of the descaling means to effect an intermediate heating of a hot-rolled steel material; and an aimed temperature computing device for obtaining the $Ac_3$ transformation temperature of the steel material and the $Ar_3$ transformation temperature of said steel material on the basis of the composition of said steel material, and to determine, mainly on the basis of said $Ac_3$ transformation temperature and said $Ar_3$ transformation temperature, an intermediate heating aimed temperature to which said steel material is to be heated by said intermediate heating device and also a final finish hot-rolling aimed temperature at which said finish hot rolling of said steel material is completed, said aimed temperature computing device being operatively connected to said intermediate heating device so as to determine the heating output of said intermediate heating device.

19. A hot rolling apparatus according to claim 18, further comprising: a first pyrometer disposed immediately downstream of said intermediate heating device so as to detect the temperature of said steel material immediately after said intermediate heating; a second pyrometer disposed immediately downstream of the final stand of said series of finish hot rolling stands means so as to detect the temperature of said steel material immediately after the completion of the final finish hot rolling; and a manipulated variable computing device for determining a first deviation of the actual temperature of said steel material measured immediately after said intermediate heating by said first pyrometer from said intermediate heating aimed temperature, and a second deviation of the actual final temperature of said steel material measured immediately after the final finish hot rolling by said second pyrometer from said final finish hot rolling and temperature, said manipulated variable computing device being further adapted to vary the degree of heating in said intermediate heating device in accordance with at least the first difference regarding the first and second temperature differences.

20. A hot rolling apparatus according to claim 19, wherein said intermediate heating device comprises an electromagnetic induction heating device.

21. A hot rolling apparatus according to claim 19, wherein said intermediate heating device is disposed along the edges of said steel material during the rolling.

* * * * *